US009670768B2

(12) United States Patent
Turner et al.

(10) Patent No.: US 9,670,768 B2
(45) Date of Patent: Jun. 6, 2017

(54) REAL-TIME TRACKING OF BENDING FATIGUE IN COILED TUBING

(71) Applicant: Halliburton Energy Services, Inc., Houston, TX (US)

(72) Inventors: Alan Charles John Turner, Stonehaven (GB); Richard Ian Gillings, Aberdeen (GB); Anna Savenkova, Aberdeen (GB)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 14/895,439

(22) PCT Filed: Feb. 13, 2015

(86) PCT No.: PCT/US2015/015885
§ 371 (c)(1),
(2) Date: Dec. 2, 2015

(87) PCT Pub. No.: WO2016/130151
PCT Pub. Date: Aug. 18, 2016

(65) Prior Publication Data

US 2016/0362973 A1 Dec. 15, 2016

(51) Int. Cl.
*E21B 17/20* (2006.01)
*E21B 19/08* (2006.01)
(Continued)

(52) U.S. Cl.
CPC ..... *E21B 47/0006* (2013.01); *E21B 17/20* (2013.01); *E21B 19/08* (2013.01); *E21B 19/22* (2013.01); *B63B 35/03* (2013.01)

(58) Field of Classification Search
CPC ..... E21B 47/0006; E21B 17/20; E21B 19/08; E21B 19/22
See application file for complete search history.

(56) References Cited

U.S. PATENT DOCUMENTS 6,321,596 B1 * 11/2001 Newman ..... E21B 19/22 73/152.45
6,408,948 B1 * 6/2002 Fontana ..... E21B 17/06 166/242.1

(Continued)

FOREIGN PATENT DOCUMENTS

EP 1245783 A2 10/2002

OTHER PUBLICATIONS

International Search Report and Written Opinion for PCT/US2015/015885 dated Oct. 22, 2015.

*Primary Examiner* — Matthew R Buck
(74) *Attorney, Agent, or Firm* — McDermott Will & Emery LLP

(57) ABSTRACT

A coiled tubing deployment system includes an offshore rig having a reel positioned thereon and coiled tubing wound on the reel. A guide arch is positioned on the offshore rig to receive the coiled tubing from the reel, and a tubing guide receives the coiled tubing from the guide arch and directs the coiled tubing into water. A depth counter measures a length of the coiled tubing deployed from the reel and generate one or more length measurement signals, and a set of bend sensors is positioned on the tubing guide to measure real-time strain assumed by the coiled tubing as deployed into the water and thereby generate one or more bend sensor signals. A data acquisition system receives the length measurement signals and the bend sensor signals and provides an output signal indicative of real-time bending fatigue of the coiled tubing at select locations along the coiled tubing.

23 Claims, 3 Drawing Sheets

(51) Int. Cl.

| | |
|---|---|
| ***E21B 19/22*** | (2006.01) |
| ***E21B 47/00*** | (2012.01) |
| *B63B 35/03* | (2006.01) |

(56) References Cited

U.S. PATENT DOCUMENTS

| | | | | |
|---|---|---|---|---|
| 8,439,109 | B2 * | 5/2013 | Sbordone | E21B 47/0001 166/250.01 |
| 8,451,441 | B2 * | 5/2013 | Nicolas | E21B 17/017 356/241.4 |
| 9,022,124 | B2 * | 5/2015 | Sorensen | E21B 19/22 166/351 |
| 2004/0065475 | A1 * | 4/2004 | Laursen | E21B 19/24 175/7 |
| 2006/0101914 | A1 | 5/2006 | McCoy | |
| 2008/0077332 | A1 | 3/2008 | Newman | |
| 2010/0097450 | A1 | 4/2010 | Pugh et al. | |
| 2014/0207390 | A1 | 7/2014 | Zheng et al. | |

* cited by examiner

REAL-TIME TRACKING OF BENDING FATIGUE IN COILED TUBING

BACKGROUND

Exploring, drilling, and completing a hydrocarbon or other type of subterranean well is generally a complicated, time-consuming, and ultimately very expensive endeavor. As such, tremendous emphasis is commonly placed on well access in the hydrocarbon recovery industry. That is, access to a well at an oilfield for monitoring its condition and maintaining its proper health is of great importance. Such access to the well is often provided by way of coiled tubing, which is particularly well suited for being driven downhole to depths of several thousand feet by an injector located at the surface. The coiled tubing is generally of sufficient strength and durability to withstand such applications. For example, the coiled tubing may be of alloy steel, stainless steel, or other suitable metal-based materials.

Coiled tubing is deployed from a coiled tubing reel that can be manageably delivered to a well site. Despite being constructed of relatively durable materials, the coiled tubing plastically deforms while winding and unwinding from the reel, which affects the low cycle fatigue life of the coiled tubing. Repeated cycling (e.g., winding and unwinding) of the coiled tubing will eventually cause the coiled tubing to lose its structural integrity in terms of force bearing capacity or pressure bearing capacity. In extreme scenarios, the wall of the coiled tubing may fail at an over-fatigued location, thereby rendering the coiled tubing unsafe or wholly unusable. In order to avoid fatigue failure during operations, the coiled tubing is generally 'retired' once a predetermined fatigue life or limit has been reached.

To calculate when the predetermined fatigue life or limit has been reached, the coiled tubing reel may be equipped with a data storage system and processor configured to monitor historical cycling or bending of the coiled tubing during operations and comparing those determinations against a fatigue life model. A degree of accuracy may be provided whereby bending of each segment of the coiled tubing is tracked as it winds and unwinds from the reel and bends in one direction or another through the turns of the injector as it advances into or is retracted from a well. As such, from one operation to the next, the actual degree of cycling for any given segment may be historically tracked. Once segments of the coiled tubing begin to reach the limits established based on the fatigue life model, the process of retiring of the coiled tubing may ensue.

When coiled tubing is used in riser-less subsea operations, however, the coiled tubing is advanced into an oftentimes turbulent ocean environment. As a result, significant bending can be assumed by the coiled tubing as a result of subsea currents, ocean heaving, and other dynamic oceanic phenomena that may act on the coiled tubing. Such dynamic oceanic phenomena is difficult, if not impossible, to predict or model. As a result, unknown fatigue may be introduced into coiled tubing when deployed in riser-less subsea operations.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to coiled tubing and, more particularly, to monitoring the fatigue life of coiled tubing in riser-less subsea operations.

Embodiments of the present disclosure provide a real-time coiled tubing fatigue tracking method that can establish the remaining life of the coiled tubing. Each time coiled tubing is deployed, the coiled tubing incurs standard plastic fatigue in bending the coiled tubing from the reel and through a guide arch. According to the present disclosure, a fatigue tracking system is used to obtain dynamic fatigue measurements of the coiled tubing as the coiled tubing assumes strain forces due to interaction with an oceanic environment below a tubing guide that deploys the coiled tubing into the water. Strain and/or gyroscopic sensors may be coupled to the tubing guide to measure the fatigue induced in the coiled tubing at that point, and these measurements may be processed by a data acquisition system that may be configured to link the measured fatigue to specific locations along the length of the coiled tubing. As a result, an operator may be provided with a fatigue history file that maps the fatigue assumed by the coiled tubing at any given point along its length. As will be appreciated, this may prove advantageous in enabling coiled tubing life spans to be lengthened and optimized.

Figure 1:
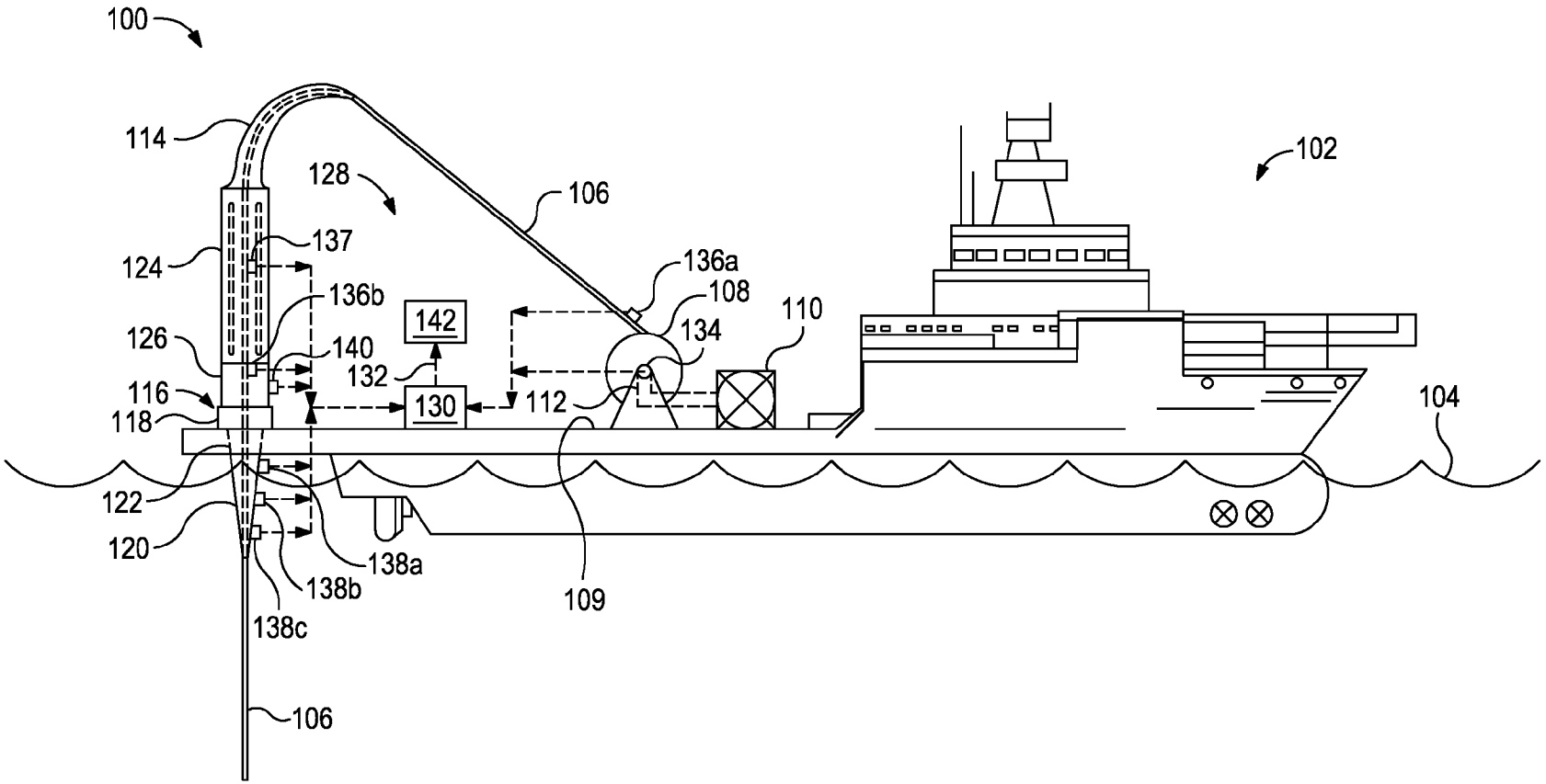
FIG. 1 is an exemplary coiled tubing deployment system that may employ the principles of the present disclosure.

Referring to FIG. 1, illustrated is an exemplary coiled tubing deployment system 100, according to one or more embodiments of the present disclosure. As illustrated, the coiled tubing deployment system 100 (hereafter "the system 100") may include or otherwise be used in conjunction with an offshore rig 102 configured to operate in an offshore environment that includes a body of water 104. In some embodiments, as illustrated, the offshore rig 102 may comprise a floating service vessel or boat. In other embodiments, however, the offshore rig 102 may comprise any offshore platform, structure, or vessel used in subsea intervention operations common to the oil and gas industry. The water 104 may comprise any body of water including, but not limited to, an ocean, a lake, a river, a stream, or any combination thereof.

The offshore rig 102 may be used to deploy coiled tubing 106 into the water 104 for various subsea purposes. In some cases, for instance, the coiled tubing 106 may be deployed for a well intervention operation where the coiled tubing 106 is coupled to and otherwise inserted into a subsea wellhead (not shown). In other embodiments, the coiled tubing 106 may comprise a conduit or umbilical used to convey fluids or power to a subsea location (not shown), such as a wellhead, a submerged platform, or a subsea pipeline. The coiled tubing 106 may be made of a variety of deformable materials including, but not limited to, a steel alloy, stainless steel, titanium, other suitable metal-based materials, thermoplastics, composite materials (e.g., carbon fiber-based materials), and any combination thereof. The coiled tubing 106 may exhibit a diameter of about 3.5 inches, but may alternatively exhibit a diameter that is greater or less than 3.5 inches, without departing from the scope of the disclosure.

The coiled tubing 106 may be deployed from a reel 108 positioned on the offshore rig 102, such as a deck 109 of the offshore rig 102. The coiled tubing 106 may be wound multiple times around the reel 108 for ease of transport. In some embodiments, a fluid source 110 may be communicably coupled to the coiled tubing 106 via a fluid conduit 112 and configured to convey a pressurized fluid, such as a gas or a liquid, into the coiled tubing 106. As will be appreciated, the presence and amount (i.e., pressure) of the pressurized fluid may affect the mechanical strength of the coiled tubing 106. For instance, depending on whether the coiled tubing 106 is pressurized or not will determine how much bending can be caused in the coiled tubing 106 during operation. Low fluid pressure will result in a first bending potential, while higher fluid pressure will result in a second bending potential.

From the reel 108, the coiled tubing 106 may be fed into a guide arch 114, commonly referred to in the oil and gas industry as a "gooseneck." The guide arch 114 redirects the coiled tubing 106 toward a tubing guide 116 operatively coupled to the guide arch 114 and fixed to the frame of the offshore rig 102. As used herein, the term "operatively coupled" refers to a direct or indirect coupling engagement between component parts of the system 100. In some embodiments, for instance, the tubing guide 116 may be directly coupled to the guide arch 114. In other embodiments, as illustrated, the tubing guide 116 may be indirectly coupled to the guide arch 114 with one or more structural components interposing the tubing guide 116 and the guide arch 114. The guide arch 114 may comprise a rigid structure that exhibits a known radius. As the coiled tubing 106 is conveyed through the guide arch 114, the coiled tubing 106 may be plastically deformed and otherwise re-shaped and re-directed for receipt by the tubing guide 116 located therebelow.

The tubing guide 116 may be any device or structure used to convey the coiled tubing 106 into the water 104. In some embodiments, the tubing guide 116 may comprise a "bend stiffener," for example. In the illustrated embodiment, the tubing guide 116 may include a flange 118 that rests on the deck 109 of the offshore rig 102 and a tapering body 120 that extends from the flange 118 through a hole 122 defined through the deck 109. In some embodiments, as illustrated, the tapering body 120 may extend to the water 104 such that the coiled tubing 106 is deployed directly into the water 104.

The flange 118 may operate to support the tubing guide 116 on the offshore rig 102, and may also provide a connection location to attach the components located thereabove so that a type of riser is effectively formed for the coiled tubing 106. Accordingly, the flange 118 may be characterized as any box-type frame or structure capable of accomplishing the aforementioned tasks. Moreover, it will be appreciated, that the tubing guide 116 may be alternatively secured to the offshore rig 102 in a variety of other ways, without departing from the scope of the disclosure. For instance, in at least one embodiment, the offshore rig 102 may include a moon pool (not shown) and the tubing guide 116 may be secured to the offshore rig 102 at or near the moon pool such that the coiled tubing 106 is deployed into the water 104 via the moon pool.

The tubing guide 116 may be configured to protect the coiled tubing 106 at a critical point of high stress assumed by the coiled tubing. The tubing guide 116 may be made of a material similar to that of the coiled tubing 106 and, therefore, the tubing guide 116 may be configured to increase the mechanical properties (e.g., rigidity) of the coiled tubing 106 as the coiled tubing 106 traverses the tubing guide 116. The size of the tubing guide 116, such as the thickness of the tapering body 120, may serve to spread critical loads assumed by the coiled tubing 106 over the length of the tubing guide 116, which may help improve the working life of the coiled tubing 106. In some embodiments, the tubing guide 116 may include a liner (not shown) that directly contacts the coiled tubing 106 as it passes through the tubing guide 116. As will be appreciated, this may prove advantageous in preventing the materials of the tubing guide 116 and the coiled tubing 106 from abrasive contact against one another.

In some embodiments, as illustrated, an injector 124 may be secured to the offshore rig 102 and interpose the guide arch 114 and the tubing guide 116. In at least one embodiment, a support frame 126 may be included to couple the injector 124 to the tubing guide 116. The injector 124 may be configured to advance or retract the coiled tubing 106 during deployment of the coiled tubing 106. In some embodiments, for example, the injector 124 may include a plurality of internal gripping elements or wheels (not shown) configured to engage the outer surface of the coiled tubing 106 to either pull the coiled tubing 106 from the reel 108 and into the tubing guide 116, or retract the coiled tubing 106 from the water 104 to be wound again on the reel 108. In some embodiments, however, the injector 124 may be omitted and the weight of the coiled tubing 106 may instead be used for deployment and the reel 108 may be motorized to retract the coiled tubing 106.

The support frame 126 may be configured to transfer the weight assumed by the injector 124 to the deck 109 of the offshore rig 102 so that the deck 109 assumes the weight over time. In embodiments where the injector 124 is omitted, the support frame 126 may comprise a short component that is able to couple the guide arch 114 to the deck 109 of the offshore rig 102.

As the coiled tubing 106 is unwound from the reel 108 and fed through the guide arch 114 and the tubing guide 116, it is plastically deformed. This cycled bending is naturally repeated in reverse upon retracting the coiled tubing 106 to be wound back around the reel 108. Moreover, in riser-less subsea applications, as shown in FIG. 1, additional forces and bending stresses can be assumed by the coiled tubing 106 as it enters the water 104. More particularly, in cases where the water 104 is open ocean, subsea currents, ocean heaving, waves, and other dynamic oceanic phenomena can all place strain and bending stress on the coiled tubing 106 as it is deployed. Over time, these bend cycles induce considerable fatigue on the coiled tubing 106 through repeated stress and strain, ultimately affecting the overall useful life of the coiled tubing 106.

Bending forces assumed by the coiled tubing 106 between the reel 108 and the injector 124 can be generally ascertained using known parameters, such as the diameter of the coiled tubing 106, the radius of the guide arch 114, and the pressure within the coiled tubing 106. Ascertaining the bending forces assumed by the coiled tubing 106 at or following the tubing guide 116, however, can be less certain in view of the unpredictable dynamic environment of the water 104, which provides essentially no known variables. According to embodiments of the present disclosure, the bending forces assumed by the coiled tubing 106 at or following the tubing guide 116 may be monitored and quantified in real-time and those measurements may be mapped along the length of the coiled tubing 106 to determine fatigue life of the coiled tubing 106.

To monitor the bending and fatigue of the coiled tubing 106 in real-time, the system 100 may further include a fatigue tracking system 128. The fatigue tracking system 128 may provide a reliable method for establishing and recording, both in real-time and in memory mode, the bending forces that are assumed by the coiled tubing 106 at or near the tubing guide 116 and otherwise in the region around the interface with the water 104. As described below, the fatigue tracking system 128 may be configured to record the resultant forces and bending levels encountered by the coiled tubing 106 and link those measurements back to the location in the coiled tubing 106 where the forces were assumed. As a result, induced fatigue and the corresponding level of bending for each section of the coiled tubing 106 run through the system 100 may be established and mapped back into a fatigue history file. Once segments of the coiled tubing 106 begin to reach predetermined fatigue limits as based on the fatigue history file, an operator may consider retiring the coiled tubing 106 to avoid failure.

As illustrated, the fatigue tracking system 128 may include a plurality of sensors and devices, each communicably coupled to a data acquisition system 130 configured to receive and process signals deriving from each sensor and/or device. The data acquisition system 130 may be a computer system, for example, that includes a memory, a processor, and computer readable instructions that, when executed by the processor, process the sensor signals to provide an output signal 132. Data corresponding to the construction parameters of the coiled tubing 106 may be provided to the data acquisition system 130 for reference. For instance, construction parameters of the coiled tubing 106 loaded into the data acquisition system 130 may include material grade, length, outer diameter, and inner diameter of the coiled tubing 106. Additional construction parameters that may be loaded into the data acquisition system 130 include the location of segment welds or joints along the body of the coiled tubing 106. The construction parameters may be used by the data acquisition system 130 as reference points in generating the fatigue history file.

The fatigue tracking system 128 may further include a pressure transducer or sensor 134 used to measure the real-time pressure within the coiled tubing 106 during operation. The pressure sensor 134 may be fluidly coupled to the coiled tubing 106 and, more particularly, communicably coupled to the coiled tubing 106 at the fluid conduit 112, which, as mentioned above, provides pressurized fluid into the coiled tubing 106 from the fluid source 110. The real-time pressure detected by the pressure sensor 134 may be conveyed to the data acquisition system 130 for processing. More particularly, the data acquisition system 130 may take into consideration the detected pressure in calculating fatigue on the coiled tubing 106 since the internal pressure may affect the mechanical strength of the coiled tubing 106.

In the illustrated embodiment, the fatigue tracking system 128 may also include a depth counter 136 located at a fixed point relative to the coiled tubing 106 and otherwise along the path traversed by the coiled tubing 106 through the system 100. In some embodiments, the depth counter 136 may be located at or immediately after the reel 108, as shown by a first depth counter 136*a*. In other embodiments, however, the depth counter 136 may be located immediately below the injector 124 and otherwise prior to the tubing guide 116, as shown by a second depth counter 136*b*. The depth counter 136 may comprise any measurement device capable of monitoring how much length of the coiled tubing 106 is deployed from the reel 108 and bypasses the depth counter 136. In some embodiments, for instance, the depth counter 136 may be a depth wheel that physically engages the coiled tubing 106 while it moves to register the traversed length or distance. In other embodiments, however, the depth counter 136 may comprise an optical measurement device, such as a laser sight capable of converting optical images into distance measurements.

Measurements obtained by the depth counter 136 may be conveyed to the data acquisition system 130 for processing. As will be appreciated, knowing the length of the coiled tubing 106 deployed, may allow the data acquisition system 130 to map the coiled tubing 106 and correlate specific real-time strain or bend measurements with the precise location where such forces were assumed by the coiled tubing 106. Accordingly, the measured distance or length may be mapped over time and correlated to fatigue at known points along the coiled tubing 106, which form part of the fatigue history file.

The fatigue tracking system 128 may further include a transducer or weight sensor 137 that is used to measure the real-time surface weight of the coiled tubing 106 during the operation. The weight sensor 137 may be coupled indirectly to the coiled tubing 106 and, more particularly, via the design of the frame of the injector 124. In embodiments where the injector 124 is omitted, the weight sensor 137 may be coupled via a mechanism (not shown) that transfers the weight of the coiled tubing 106 onto the deck 109. Such a mechanism may comprise, for example, a work window into which a set of slip rams can be used to hold stationary the coiled tubing 106 or via a load cell located below the guide arch 114. The real-time weight measurements detected by the weight sensor 137 may be conveyed to the data acquisition system 130 for processing and the data acquisition system 130 may take into consideration the detected weight in calculating fatigue on the coiled tubing 106.

The fatigue tracking system 128 may further include a first set of bend sensors 138*a* located at a first location on the tubing guide 116. More particularly, the first set of bend sensors 138*a* may be coupled to the tapered body 120 below the flange 118 and may be configured to measure real-time strain assumed by the coiled tubing 106 as it is deployed into the water 104. The first set of bend sensors 138*a* may include at least one of a strain sensor and a gyroscopic sensor used to determine the strain on the coiled tubing 106 at the first location. The highest strain readings and critical bending points for the coiled tubing 106 following the guide arch 114 will be at the tubing guide 116 just below the flange 118. And since the coiled tubing 106 is constantly moving through the tubing guide 116, the first set of bend sensors 138*a* may be coupled to the tubing guide 116 and the strain measured on the tubing guide 116 may be indicative of the strain assumed by the coiled tubing 106 at the first location. Sensor signals derived from the first set of bend sensors 138*a* may be conveyed to the data acquisition system 130 for processing.

In some embodiments, the fatigue tracking system 128 may optionally include at least one more set of bend sensors, shown in FIG. 1 as a second set of bend sensors 138*b* located at a second location on the tubing guide 116, and a third set of bend sensors 138*c* located at a third location on the tubing guide 116. The second and third locations may be below the first location and otherwise at locations along the tapered body 120 that exhibit smaller thicknesses as compared to the first location. Similar to the first set of bend sensors 138*a*, the first and/or second sets of bend sensors 138*b,c* may include at least one of a strain sensor and a gyroscopic sensor used to determine the strain on the coiled tubing 106 at the second and third locations, respectively. As will be appreciated, the bending assumed by the coiled tubing 106 may be more severe or pronounced nearer the end of the tubing guide 116. The second and third sets of bend sensors 138*b,c* may be configured to detect and report this resultant movement. Sensor signals derived from the second and third sets of bend sensors 138*b,c* may be conveyed to the data acquisition system 130 for processing. As will be appreciated, the length of the tubing guide 116 may vary from project to project and, as a result, the number of sets of bend sensors 138*a-c* may also vary for optimization. Moreover, since the obtained data will be recorded and matched to known segments or intervals of the coiled tubing 106, an increased number of locations to collect data points along the tubing guide 116 may enable increased accuracy.

In at least one embodiment, the fatigue tracking system 128 may further include a set of reference sensors 140 located at a fixed surface point, such as just above the tubing guide 116 and otherwise above the anticipated critical bending point in the coiled tubing 106. The reference sensors 140 may include a strain sensor and an accelerometer, and sensor signals derived from the reference sensors 140 may be conveyed to the data acquisition system 130 for processing. The reference sensors 140 may be configured to monitor and detect heave and movement of the surface vessel 102 during operation. In the illustrated embodiment, the reference sensors 140 are depicted as being coupled to the support frame 126, but may equally be coupled at any fixed point above the tubing guide 116 following the guide arch 114, without departing from the scope of the disclosure. In some embodiments, the strain sensor may be located prior to the tubing guide 116 and after the guide arch 114, while the accelerometer may be fixedly attached anywhere on the offshore rig 102 to detect the heave and movement of the offshore rig 102 during operation.

Figure 1A:
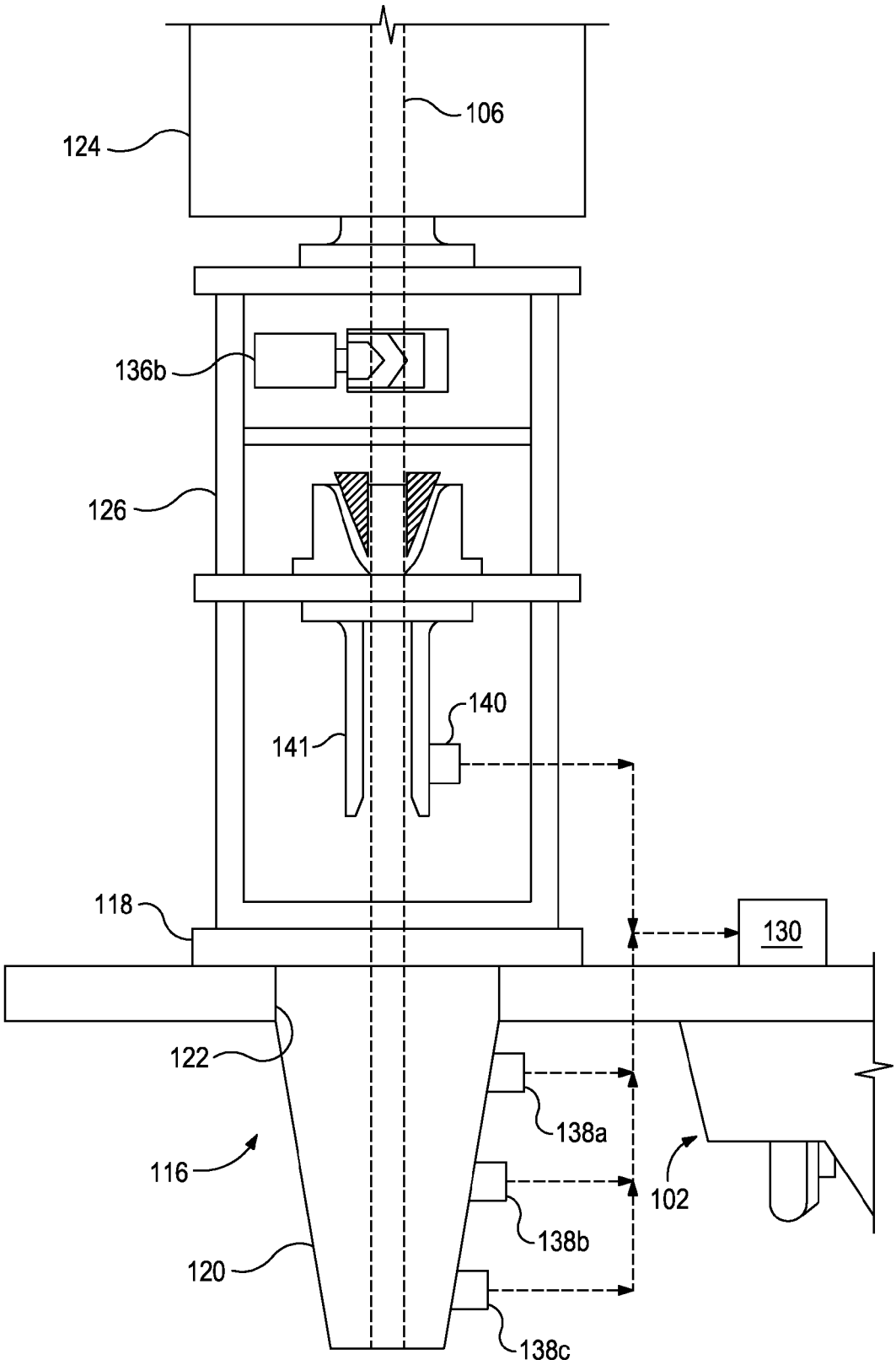
FIG. 1A is an enlarged view of a portion of the coiled tubing deployment system of FIG. 1.

Referring briefly to FIG. 1A, with continued reference to FIG. 1, an enlarged view of the exemplary support frame 126 is depicted as interposing the injector 124 and the tubing guide 116, according to one or more embodiments. As illustrated, the support frame 126 may operate as a work window and thereby facilitate access to the coiled tubing 106. Moreover, in the illustrated embodiment, the set of reference sensors 140 is depicted as being positioned on a spool riser 141 located above the top of the tubing guide 116. In some embodiments, the fatigue tracking system 128 may include multiple sets of reference sensors 140, without departing from the scope of the disclosure.

The measurements obtained by the reference sensors 140 may provide a control point or offset that may be applied to the first set of bend sensors 138*a* (and optionally the measurements derived from the second the third sets of bend sensors 138*b,c*, if used). More particularly, the data acquisition system 130 may apply the measurements derived from the reference sensors 140 to the first set of bend sensors 138*a* (and optionally the measurements derived from the second and third sets of bend sensors 138*b,c*, if used) to remove the motion of the surface vessel 102 and the stresses created from bending assumed above the tubing guide 116. Accordingly, in at least one embodiment, the data acquisition system 130 may process the sensor signals derived from the first set of bend sensors 138*a* in view of reference measurements derived from the reference sensors 140.

Each of the sensors 134, 137, 138*a-c*, 140 and the depth counter 136 may be communicably coupled to the data acquisition system 130 and configured to transmit corresponding measurements thereto in real-time via any known means of telecommunication or data transmission. In some embodiments, for instance, the data acquisition system 130 may be physically wired to one or more of the sensors 134, 137, 138*a-c*, 140 and the depth counter 136 such as through electrical or fiber optic lines. In other embodiments, however, one or more of the sensors 134, 137, 138*a-c*, 140 and the depth counter 136 may be configured to wirelessly communicate with the data acquisition system 130, such as via electromagnetic telemetry, acoustic telemetry, ultrasonic telemetry, radio frequency transmission, or any combination thereof.

In some embodiments, as illustrated, the data acquisition system 130 may be arranged at or near the offshore rig 102. In other embodiments, however, the data acquisition system 130 may be remotely located and the sensors 134, 137, 138*a-c*, 140 and the depth counter 136 may be configured to communicate remotely with the data acquisition system 130 (either wired or wirelessly). The data acquisition system 130 may be configured to receive and process the various signals from the sensors 134, 137, 138*a-c*, 140 and the depth counter 136 in conjunction with the construction parameters of the coiled tubing 106. The relative distances between the sensors 134, 137, 138*a-c*, 140 and the depth counter 136 may also be used as configurable parameters within the data acquisition system 130 in generating the output signal 132.

The output signal 132 may comprise real-time bending data corresponding to specific locations along the length of the coiled tubing 106. In some embodiments, such data may be stored for future reference or consideration. In other embodiments, however, the output signal 132 may be conveyed to a peripheral device 142 for consideration and/or review by an operator in real-time. The peripheral device 142 may include, but is not limited to, a monitor (e.g., a display, a GUI, a handheld device, a tablet, etc.), a printer, an alarm, additional storage memory, etc. In some embodiments, the peripheral device 142 may be configured to provide the operator with a graphical output or display that charts or maps the length of the coiled tubing 106 versus estimated fatigue on the coiled tubing 106 at any given location. Accordingly, given that fatigue life of the coiled tubing 106 is largely a matter of repeated usage, the data acquired by the data acquisition system 130 may be stored and historically tied to the specific coiled tubing 106 and thereby form part of the fatigue history file corresponding to the coiled tubing 106.

Figure 2:
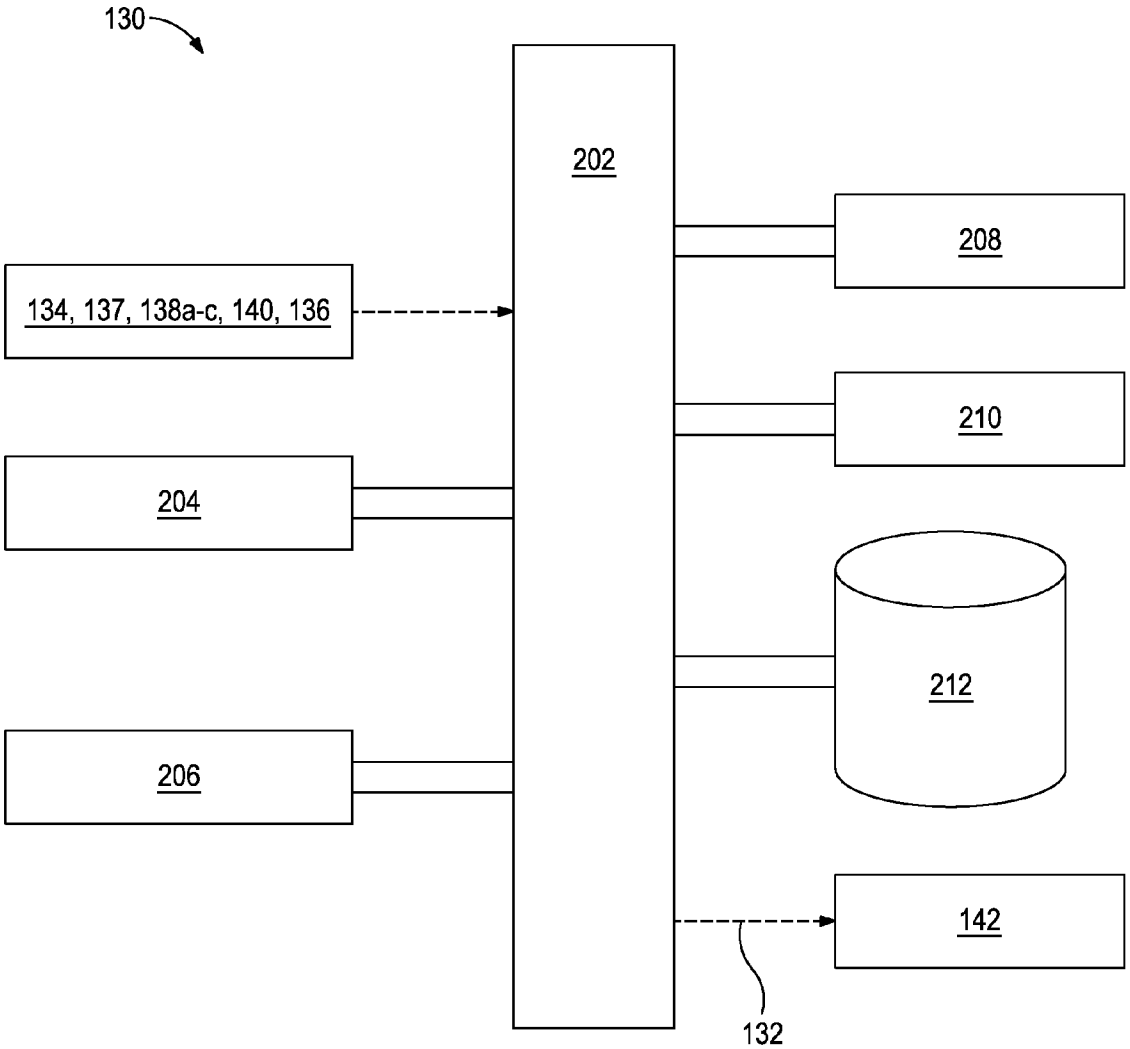
FIG. 2 is a block diagram of the data acquisition system of FIG. 1.

Referring now to FIG. 2, with continued reference to FIG. 1, illustrated is a block diagram of the data acquisition system 130, according to one or more embodiments. As illustrated, the data acquisition system 130 may include a bus 202, a communications unit 204, one or more controllers 206, a non-transitory computer readable medium (i.e., a memory) 208, a computer program 210, and a library or database 212. The bus 202 may provide electrical conductivity and a communication pathway among the various components of the data acquisition system 130. The communications unit 204 may employ wired or wireless communication technologies, or a combination thereof. The communications unit 204 can include communications operable among land locations, sea surface locations both fixed and mobile, and undersea locations both fixed and mobile. The computer program 210 may be stored partially or wholly in the memory 208 and, as generally known in the art, it may be in the form of microcode, programs, routines, or graphical programming.

In exemplary operation, the data acquisition system 130 receives and samples one or more signals derived from the sensors 134, 137, 138*a-c*, 140 and the depth counter 136. The controller 206 may be configured to transfer the sensor signals to the memory 208, which may encompass at least one of volatile or non-volatile memory. The computer program 210 may be configured to access the memory 208 and process the sensor signals in real-time. In some embodiments, however, the sensor signals may be logged or otherwise stored in the memory 208 or the database 212 for post-processing review or analysis.

In processing the sensor signals, the computer program 210 may be configured to digitize the sensor signal and generate digital data. The computer program 210 may employ pre or post-acquisition processing by applying one or more signal amplifiers and/or signal filters (e.g., low, medium, and/or high-pass frequency filters) in hardware or software. In some embodiments, the computer program 210 may be configured to output the acquired signal in the time domain, thereby providing a time domain output. In another embodiment, the computer program 210 may also be capable of transforming and outputting the digital data in the frequency domain, thereby providing a frequency domain output. This transformation into the frequency domain may be accomplished using several different frequency-based processing methods including, but not limited to, fast Fourier transforms (FFTs), short-time Fourier transforms (STFTs), wavelets, the Goertzel algorithm, or any other domain conversion methods or algorithms known by those skilled in the art. In some embodiments, one or both of the time domain and frequency domain signals may be filtered using at least one of a low-pass filter, a medium-pass filter, and a high-pass filter or other types of filtering techniques, without departing from the scope of the disclosure.

The computer program 210 may further be configured to query the database 212 for stored data corresponding to construction parameters of the coiled tubing 106 and relative distances between the sensors 134, 137, 138*a-c*, 140 and the depth counter 136. Upon querying the database 212, the computer program 210 may be able to apply the construction parameters and relative distances to the measured signals. The computer program 210 may then deliver the output signal 132 comprising real-time bending data corresponding to specific locations along the length of the coiled tubing 106. In some cases, as indicated above, the output signal 132 may be provided to the peripheral device 142 for display. In other embodiments, or in addition thereto, the data acquired by the data acquisition system 130 may be stored and historically tied to the fatigue history file corresponding to the coiled tubing 106.

Embodiments disclosed herein include:

A. A coiled tubing deployment system that includes an offshore rig having a reel positioned thereon and coiled tubing wound on the reel, the offshore rig being deployable on water, a guide arch positioned on the offshore rig to receive the coiled tubing from the reel, a tubing guide fixed to the offshore rig and operatively coupled to the guide arch to receive the coiled tubing from the guide arch and direct the coiled tubing into the water, a depth counter positioned at a fixed point relative to the coiled tubing to measure a length of the coiled tubing deployed from the reel and generate one or more length measurement signals, a weight sensor positioned at a fixed point relative to the coiled tubing to measure a weight of the coiled tubing generate one or more weight measurement signals, a first set of bend sensors positioned at a first location on the tubing guide to measure real-time strain assumed by the coiled tubing is deployed into the water and thereby generate one or more first bend sensor signals, and a data acquisition system communicably coupled to the depth counter, the weight sensor, and the first set of bend sensors to receive and process the one or more length measurement signals, the one or more weight measurement signals, and the one or more first bend sensor signals, the data acquisition system providing an output signal indicative of real-time bending fatigue of the coiled tubing at select locations along the coiled tubing.

B. A method that includes deploying coiled tubing from a reel positioned on an offshore rig and receiving the coiled tubing with a guide arch positioned on the offshore rig, receiving the coiled tubing from the guide arch with a tubing guide fixed to the offshore rig and conveying the coiled tubing into water below the offshore rig from the tubing guide, measuring a length of the coiled tubing deployed from the reel with a depth counter positioned at a fixed point relative to the coiled tubing and thereby generating one or more length measurement signals, measuring a weight of the coiled tubing with a weight sensor positioned at a fixed point relative to the coiled tubing and thereby generating one or more weight measurement signals, measuring real-time strain assumed by the coiled tubing is deployed into the water with a first set of bend sensors positioned at a first location on the tubing guide and thereby generating one or more first bend sensor signals, receiving and processing the one or more length measurement signals, the one or more weight measurement signals, and the one or more first bend sensor signals with a data acquisition system communicably coupled to the depth counter and the first set of bend sensors, and generating an output signal with the data acquisition system indicative of real-time bending fatigue of the coiled tubing at select locations along the coiled tubing.

Each of embodiments A and B may have one or more of the following additional elements in any combination: Element 1: wherein the offshore rig comprises a vessel selected from the group consisting of a service vessel, a boat, a floating platform, an offshore platform, a floating structure, and any combination thereof. Element 2: wherein the tubing guide includes a flange and a body that extends from the flange, and wherein the first set of bend sensors is coupled to the body. Element 3: wherein the first set of bend sensors includes at least one of a strain sensor and a gyroscopic sensor. Element 4: further comprising a second set of bend sensors positioned at a second location on the tubing guide to measure the real-time strain assumed by the coiled tubing at the second location, wherein the second set of bend sensors generate one or more second bend sensor signals to be received and processed by the data acquisition system and used in determining the real-time bending fatigue of the coiled tubing. Element 5: further comprising an injector that interposes the guide arch and the tubing guide. Element 6: further comprising a support frame that couples the injector to the tubing guide. Element 7: wherein the fixed point relative to the coiled tubing is immediately after the reel and prior to the guide arch. Element 8: wherein the fixed point relative to the coiled tubing is prior to the tubing guide and after the guide arch. Element 9: wherein construction parameters for the coiled tubing are stored in a memory of the data acquisition system, and wherein the construction parameters are used to determine the real-time bending fatigue of the coiled tubing. Element 10: further comprising a pressure sensor fluidly coupled to the coiled tubing to obtain real-time pressure measurements within the coiled tubing, wherein the data acquisition system receives and processes the real-time pressure measurements in determining the real-time bending fatigue of the coiled tubing. Element 11: further comprising a set of reference sensors coupled to the offshore rig at a fixed surface point to monitor and detect heave and movement of the offshore rig and generate reference signals, wherein the data acquisition system receives and processes the reference signals to remove motion effects of the offshore rig from the one or more first bend sensor signals in determining the real-time bending fatigue of the coiled tubing. Element 12: wherein the set of reference sensors includes a strain sensor and an accelerometer, the strain sensor being located prior to the tubing guide and after the guide arch and the accelerometer being fixedly attached anywhere on the offshore rig to detect the heave and movement of the offshore rig. Element 13: further comprising a peripheral device communicably coupled to the data acquisition system to receive the output signal and provide a graphical output corresponding to the real-time bending fatigue of the coiled tubing at the select locations along the coiled tubing.

Element 14: wherein the tubing guide includes a flange and a body that extends from the flange, and the first set of bend sensors is coupled to the body, and wherein measuring the real-time strain assumed by the coiled tubing with the first set of bend sensors comprises measuring the strain on the tubing guide at the first location, the strain on the tubing guide corresponding to the real-time strain assumed by the coiled tubing at the first location. Element 15: further comprising measuring the real-time strain assumed by the coiled tubing at a second location on the tubing guide with a second set of bend sensors positioned at the second location, and thereby generating one or more second bend sensor signals, and receiving and processing the one or more second bend sensor signals with the data acquisition system in determining the real-time bending fatigue of the coiled tubing. Element 16: wherein construction parameters for the coiled tubing are stored in a memory of the data acquisition system, the method further comprising accessing using the construction parameters in determining the real-time bending fatigue of the coiled tubing. Element 17: further comprising obtaining real-time pressure measurements within the coiled tubing with a pressure sensor fluidly coupled to the coiled tubing, and receiving and processing the real-time pressure measurements with the data acquisition system in determining the real-time bending fatigue of the coiled tubing. Element 18: further comprising monitoring and detecting heave and movement of the offshore rig with a set of reference sensors coupled to the offshore rig at a fixed surface point, generating reference signals with the set of reference sensors indicative of real-time heave and movement of the offshore rig, and receiving and processing the reference signals with the data acquisition system and thereby removing motion effects of the offshore rig from the one or more first bend sensor signals in determining the real-time bending fatigue of the coiled tubing. Element 19: further comprising receiving the output signal with a peripheral device communicably coupled to the data acquisition system, and generating a graphical output corresponding to the real-time bending fatigue of the coiled tubing at the select locations along the coiled tubing. Element 20: wherein generating the graphical output comprises generating a map of the coiled tubing versus estimated fatigue on the coiled tubing at select locations along the coiled tubing. Element 21: further comprising mapping the coiled tubing with the data acquisition system to obtain a fatigue history file for the coiled tubing.

By way of non-limiting example, exemplary combinations applicable to A, B, and C include: Element 2 with Element 3; Element 2 with Element 4; Element 5 with Element 6; Element 11 with Element 12; Element 14 with Element 15; and Element 19 with Element 20.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A coiled tubing deployment system, comprising:

an offshore rig having a reel positioned thereon and coiled tubing wound on the reel, the offshore rig being deployable on water;

a guide arch positioned on the offshore rig to receive the coiled tubing from the reel;

a tubing guide fixed to the offshore rig and operatively coupled to the guide arch to receive the coiled tubing from the guide arch and to direct the coiled tubing into the water;

a depth counter positioned at a first fixed point relative to the coiled tubing to measure a length of the coiled tubing deployed from the reel and to generate one or more length measurement signals;

a weight sensor positioned at a second fixed point relative to the coiled tubing to measure a weight of the coiled tubing and to generate one or more weight measurement signals;

a first set of bend sensors positioned at a first location on the tubing guide to measure real-time strain assumed by the coiled tubing when deployed into the water and thereby generate one or more first bend sensor signals; and a data acquisition system communicably coupled to the depth counter, the weight sensor, and the first set of bend sensors to receive and process the one or more length measurement signals, the one or more weight measurement signals, and the one or more first bend sensor signals, the data acquisition system providing an output signal indicative of real-time bending fatigue of the coiled tubing at select locations along the coiled tubing.

2. The coiled tubing deployment system of claim 1, wherein the offshore rig comprises a vessel selected from the group consisting of a service vessel, a boat, a floating platform, an offshore platform, a floating structure, and any combination thereof.

3. The coiled tubing deployment system of claim 1, wherein the tubing guide includes a flange and a body that extends from the flange, and wherein the first set of bend sensors is coupled to the body.

4. The coiled tubing deployment system of claim 3, wherein the first set of bend sensors includes at least one of a strain sensor and a gyroscopic sensor.

5. The coiled tubing deployment system of claim 3, further comprising a second set of bend sensors positioned at a second location on the tubing guide to measure the real-time strain assumed by the coiled tubing at the second location, wherein the second set of bend sensors generate one or more second bend sensor signals to be received and processed by the data acquisition system and used in determining the real-time bending fatigue of the coiled tubing.

6. The coiled tubing deployment system of claim 1, further comprising an injector that interposes the guide arch and the tubing guide.

7. The coiled tubing deployment system of claim 6, further comprising a support frame that couples the injector to the tubing guide.

8. The coiled tubing deployment system of claim 1, wherein the first fixed point relative to the coiled tubing is immediately after the reel and prior to the guide arch.

9. The coiled tubing deployment system of claim 1, wherein the first fixed point relative to the coiled tubing is prior to the tubing guide and after the guide arch.

10. The coiled tubing deployment system of claim 1, wherein construction parameters for the coiled tubing are stored in a memory of the data acquisition system, and wherein the construction parameters are used to determine the real-time bending fatigue of the coiled tubing.

11. The coiled tubing deployment system of claim 1, further comprising a pressure sensor fluidly coupled to the coiled tubing to obtain real-time pressure measurements within the coiled tubing, wherein the data acquisition system receives and processes the real-time pressure measurements in determining the real-time bending fatigue of the coiled tubing.

12. The coiled tubing deployment system of claim 1, further comprising a set of reference sensors coupled to the offshore rig at a fixed surface point to monitor and detect heave and movement of the offshore rig and generate reference signals, wherein the data acquisition system receives and processes the reference signals to remove motion effects of the offshore rig from the one or more first bend sensor signals in determining the real-time bending fatigue of the coiled tubing.

13. The coiled tubing deployment system of claim 12, wherein the set of reference sensors includes a strain sensor and an accelerometer, the strain sensor being located prior to the tubing guide and after the guide arch and the accelerometer being fixedly attached anywhere on the offshore rig to detect the heave and movement of the offshore rig.

14. The coiled tubing deployment system of claim 1, further comprising a peripheral device communicably coupled to the data acquisition system to receive the output signal and provide a graphical output corresponding to the real-time bending fatigue of the coiled tubing at the select locations along the coiled tubing.

15. A method, comprising:

deploying coiled tubing from a reel positioned on an offshore rig and receiving the coiled tubing with a guide arch positioned on the offshore rig;

receiving the coiled tubing from the guide arch with a tubing guide fixed to the offshore rig and conveying the coiled tubing into water below the offshore rig from the tubing guide;

measuring a length of the coiled tubing deployed from the reel with a depth counter positioned at a first fixed point relative to the coiled tubing and thereby generating one or more length measurement signals;

measuring a weight of the coiled tubing with a weight sensor positioned at a second fixed point relative to the coiled tubing and thereby generating one or more weight measurement signals;

measuring real-time strain assumed by the coiled tubing when deployed into the water with a first set of bend sensors positioned at a first location on the tubing guide and thereby generating one or more first bend sensor signals;

receiving and processing the one or more length measurement signals, the one or more weight measurement signals, and the one or more first bend sensor signals with a data acquisition system communicably coupled to the depth counter, the weight sensor, and the first set of bend sensors; and generating an output signal with the data acquisition system indicative of real-time bending fatigue of the coiled tubing at select locations along the coiled tubing.

16. The method of claim 15, wherein the tubing guide includes a flange and a body that extends from the flange, and the first set of bend sensors is coupled to the body, and wherein measuring the real-time strain assumed by the coiled tubing with the first set of bend sensors comprises measuring the strain on the tubing guide at the first location, the strain on the tubing guide corresponding to the real-time strain assumed by the coiled tubing at the first location.

17. The method of claim 16, further comprising:

measuring the real-time strain assumed by the coiled tubing at a second location on the tubing guide with a second set of bend sensors positioned at the second location, and thereby generating one or more second bend sensor signals; and receiving and processing the one or more second bend sensor signals with the data acquisition system in determining the real-time bending fatigue of the coiled tubing.

18. The method of claim 15, wherein construction parameters for the coiled tubing are stored in a memory of the data acquisition system, the method further comprising accessing using the construction parameters in determining the real-time bending fatigue of the coiled tubing.

19. The method of claim 15, further comprising:

obtaining real-time pressure measurements within the coiled tubing with a pressure sensor fluidly coupled to the coiled tubing; and receiving and processing the real-time pressure measurements with the data acquisition system in determining the real-time bending fatigue of the coiled tubing.

20. The method of claim 15, further comprising:

monitoring and detecting heave and movement of the offshore rig with a set of reference sensors coupled to the offshore rig at a fixed surface point;

generating reference signals with the set of reference sensors indicative of real-time heave and movement of the offshore rig; and receiving and processing the reference signals with the data acquisition system and thereby removing motion effects of the offshore rig from the one or more first bend sensor signals in determining the real-time bending fatigue of the coiled tubing.

21. The method of claim 15, further comprising:

receiving the output signal with a peripheral device communicably coupled to the data acquisition system; and generating a graphical output corresponding to the real-time bending fatigue of the coiled tubing at the select locations along the coiled tubing.

22. The method of claim 21, wherein generating the graphical output comprises generating a map of the coiled tubing versus estimated fatigue on the coiled tubing at select locations along the coiled tubing.

23. The method of claim 15, further comprising mapping the coiled tubing with the data acquisition system to obtain a fatigue history file for the coiled tubing.

* * * * *